United States Patent [19]

Salice

[11] Patent Number: 4,701,979

[45] Date of Patent: Oct. 27, 1987

[54] FURNITURE HINGE

[75] Inventor: Luciano Salice, Carimate, Italy

[73] Assignee: Arturo Salice, S.p.A., Como, Italy

[21] Appl. No.: 755,798

[22] Filed: Jul. 17, 1985

[30] Foreign Application Priority Data

Jul. 17, 1984 [DE] Fed. Rep. of Germany ..... 3426353
Nov. 20, 1984 [DE] Fed. Rep. of Germany ..... 3442421

[51] Int. Cl.[4] ..... E05D 11/10
[52] U.S. Cl. ..... 16/346; 16/382
[58] Field of Search ..... 16/382, 383, 238, 245, 16/246, 370, DIG. 43

[56] References Cited

U.S. PATENT DOCUMENTS 3,940,829 3/1976 Grunert et al. ..... 16/246

*Primary Examiner*—Robert P. Olszewski
*Assistant Examiner*—Maurina Rachuba
*Attorney, Agent, or Firm*—Morgan & Finnegan

[57] ABSTRACT

A furniture hinge comprises a pot-shaped hinge member, which is adapted to be secured to a door or flap and is connected to a hinge bracket by means of two links and pivot pins forming a rectangular or trapezoidal array. The furniture hinge comprises also a base plate, which is adapted to be secured to a carrying wall and to which the hinge bracket is pivotally and longitudinally slidably connected. An adjusting screw is provided for imparting a pivotal movement to the hinge bracket so as to effect a lateral adjustment of the door or flap relative to the carrying wall. The pivotal movement of the hinge bracket tends to effect a change of the width of a gap that is defined by the door or flap and the carrying wall. In accordance with the invention, means are provided which ensure that the pivotal movement of the hinge bracket will be accompanied by a longitudinal displacement of the hinge bracket in such a direction and to such an extent that the tendency of the pivotal movement to change the width of the gap will be compensated for.

20 Claims, 15 Drawing Figures

FURNITURE HINGE

BACKGROUND OF THE INVENTION

1. Field of the Invention

This invention relates to a furniture hinge comprising a pot-shaped hinge member, which is adapted to be secured to a door or flap and is connected to a hinge bracket by means of two links and pivot pins forming a rectangular or trapezoidal array, a base plate, which is adapted to be secured to a carrying wall so that the latter is adapted to define a gap with the door or flap, an intermediate plate, which is mounted on the base plate and adjustable relative thereto at least in the longitudinal direction of the intermediate plate and pivotally connects the hinge bracket to the base plate, and an adjusting screw, which is screwed into the hinge bracket and is rotatably mounted in and axially fixed to the intermediate plate and is operable to effect a lateral adjustment of the door or flap by imparting a pivotal movement to the hinge bracket and is adapted to retain the hinge bracket in different angular positions.

2. Description of the Prior Art

German Patent Publication No. 23 42 113 describes a furniture hinge of that kind, in which the adjusting screw can be rotated to pivotally move the hinge bracket relative to the base plate, which is connected to the carrying wall. In this manner the door or flap can be adjusted laterally or in height in the plane in which the links are pivotally movable. Such a lateral adjustment of doors may be required, e.g., in order to align edges of the door with edges of corpus parts, or to provide sufficient space between doors hinged to a carrying wall so that the doors will not obstruct each other during their opening movement.

For instance, when a door is to be laterally adjusted by a pivotal movement of the hinge bracket away from the carrying wall to which the hinge bracket is secured, the hinge bracket will include an obtuse angle with the door just as when the door has been slightly opened although the door is actually in a closed position, in which it is supported by corpus parts or by a door frame. Because by such lateral adjustment the links are pivotally moved as during a slight opening of the door, the gap, i.e., the distance between the end face of the carrying wall and the door, will increase, it is necessary in the known furniture hinges after each lateral adjustment of the door or vertical adjustment of the flap to impart a pivotal movement to the hinge bracket in order to re-adjust said gap since the intermediate plate is adjusted on the base plate in an axial direction. The repeatedly required re-adjustment of the gap is inconvenient, complicated and time-consuming.

SUMMARY OF THE INVENTION

For this reason it is an object of the invention to provide a furniture hinge which is of the kind described first hereinbefore and in which the width of the gap that has been adjusted will not be changed by a pivotal movement imparted to the hinge bracket for effecting a lateral adjustment of a door or a vertical adjustment of a flap.

This object is accomplished in accordance with the invention in that the hinge bracket is guided in guides defined by the intermediate plate in such a manner that during a pivotal movement of the hinge bracket the latter will be displaced in its longitudinal direction relative to the intermediate plate in such a direction and to such an extent as to compensate for the tendency of said pivotal movement of the hinge bracket to change the width of the gap. In the furniture hinge in accordance with the invention the hinge bracket is guided in guides defined by the intermediate plate or the intermediate plate is guided in guides defined by the hinge bracket so that a pivotal movement of the two parts relative to each other will be supplemented by a translational movement, which compensates for the tendency of the pivotal movement of the links to change the width of the gap defined by the closed door.

In a preferred embodiment of the invention the intermediate plate and the hinge bracket are channel members, at least one flange of the channel members is formed with a slot, which is inclined toward the gap and receives a pin, which is secured to the adjacent flange of the other channel member, the adjusting screw has a tapered forward shank portion, which extends through a longitudinallly extending slot formed in the intermediate plate and through a bore in a spring washer, and the shank portion is provided with a rivet head, by which the adjusting screw is rotatably mounted and axially fixed in the slot.

In accordance with a further feature of the invention at least one flange of the channel members consisting of the intermediate plate and the hinge bracket is provided in its rear portion with a slot, which is inclined in a sense that is opposite to the inclination of the first-mentioned slot and which receives a pin that is secured to a flange of the other channel member. In accordance with a further feature of the invention the channel-shaped intermediate plate is longitudinally slidably guided on a web of the base plate and is adapted to be fixed in position by a fixing screw, and each flange of the channel-shaped hinge bracket is provided with an angled lug, which extends into one of two guiding grooves, which are defined by the end faces of the flanges of the intermediate plate and by the base plate.

The web of the base plate is suitably symmetrical with respect to its longitudinal and transverse axes so that the door can be mounted on the left and right.

In accordance with a further feature of the invention the intermediate plate constitutes an additional adjusting plate, which is adapted to be releasably locked to a lower intermediate plate, which is longitudinally slidably guided on the base plate and adapted to be fixed in position to the base plate by a clamp screw. That design permits a simplified mounting because the hinge bracket can be fixed in that the adjusting plate is simply slidably fitted on the intermediate plate. The possibility provided by the invention to effect a lateral adjustment without a change of the width of the gap will be particularly advantageous if the adjusting plate carrying the hinge bracket is connected to the intermediate plate by a detent or snap joint, which permits a quick assembly, because the compensation of the tendency to change the width of the gap during a lateral adjustment will be independent of the means by which the hinge bracket is secured to the base plate.

The adjusting plate is suitably provided with a stop for limiting the movement by which the adjusting plate is slidably fitted on the lower intermediate plate, and the adjusting plate is suitably provided at its rear end with a spring-loaded detent lever having a detent face which is constituted by an eccentric cam, which detent lever snaps into a detent position when the adjusting plate has been slidably fitted on the intermediate plate, and the detent face bears in said detent position on the rear end face of the intermediate plate in self-biasing engagement. Such a self-biasing snap joint is known from the prior German Patent Application No. P 33 45 063.3-23, which is not a prior publication and corresponds to the inventor's U.S. patent application Ser. No. 676,421 filed Nov. 29, 1984.

The stop suitably consists of a hook-shaped forward portion of the adjusting plate and embraces the forward side of the lower intermediate plate. The hinge bracket may be provided with lugs, which are angled from its flanges and are guided in guides, which are defined by the lower end faces of the flanges of the lower intermediate plate and by the base plate. The channel-shaped lower intermediate plate may also be symmetrical with respect to its longitudinal and transverse axes so that a door may be mounted on the left and right in a simple manner.

In a furniture hinge which is known from German Patent Specification No. 28 15 816 and defined in the prior-art portion of claim 11, the object set forth is accomplished in accordance with the invention in that the intermediate plate is guided on the base plate in such a manner that a pivotal movement of the intermediate plate will be accompanied by a displacement of the intermediate plate in its longitudinal direction relative to the base plate in such a direction and to such an extent that the tendency of the pivotal movement to change the width of the gap will be compensated for, the adjusting screw has a tapered threadless forward shank portion, which extends through a longitudinal slot of the base plate and through a bore of a spring washer, and the forward shank portion is provided with a rivet head for rotatably and longitudinally slidably mounting the adjusting screw in the slot in the base plate. That design in accordance with the invention is basically similar to the furniture hinge in accordance with claim 1. The main difference resides in the fact that the lateral adjustment accompanied by a compensation of the tendency to change the width of the gap is no longer effected between the hinge bracket and the intermediate plate but is effected between the intermediate plate and the base plate. In that arrangement the properly adjusted hinge bracket can be clamped on the intermediate plate in the manner known from German Patent Specification No. 28 15 816.

In accordance with a further feature of the invention the hinge bracket may be adapted to be secured by a snap joint to a further intermediate plate, which is mounted on the pivoted intermediate plate and adapted to be adjusted thereon and to be fixed in position. That embodiment requires an additional intermediate plate but permits a desirable quick mounting in that the hinge bracket is simply slidably fitted on the further intermediate plate.

In another embodiment of a furntiture hinge as defined in the prior-art portion of claim 14, the object set forth is accomplished in that the axis of the adjusting screw has such an inclination that a pivotal movement of the hinge bracket will be accomp-anied by a longitudinal displacement of the hinge bracket on the base plate or intermediate plate in such a direction and to such an extent as to compensate for the tendency of the pivotal movement to change the width of the gap. In that embodiment the adjusting screw serves to impart a pivotal movement to the hinge bracket and to compensate for the tendency of the pivotal movement to change the width of the gap so that there is no need for separate inclined guides. In this embodiment compensation is effected by a corresponding longitudinal displacement imparted to the hinge bracket during its pivotal movement. This will simplify the structure of the means for fixing the hinge bracket and the elimination of guiding and fixing means will increase the free space inside the hinge bracket so that the space can be utilized in an improved manner.

The hinge bracket may be secured to the base plate directly or by means of an intermediate plate.

It is known per se from Published German Application No. 28 19 100 that the adjusting screw for laterally adjusting the door may have a slight inclination. But that inclination of the adjusting screw does not serve for a longitudinal displacement of the hinge bracket during its pivotal movement in order to compensate the tendency of the pivotal movement of the hinge bracket to change the width of the gap. In the known hinge, the inclined adjusting screw serves only to cant a base disc in guides of the base plate in order to reduce or eliminate a backlash which may be due to manufacturing tolerances. When a door provided with the known hinge has been laterally adjusted by an actuation of the adjusting screw, it is still necessary to exactly adjust the gap in the direction of the depth of the furniture by separate adjusting means.

Additional desirable features and advantages of the invention will be evident from the following description of the preferred embodiments thereof which is to be taken in conjunction with the accompanying Drawings.

DETAILED DESCRIPTION OF THE PREFERRED EMBODIMENTS

Figure 1:
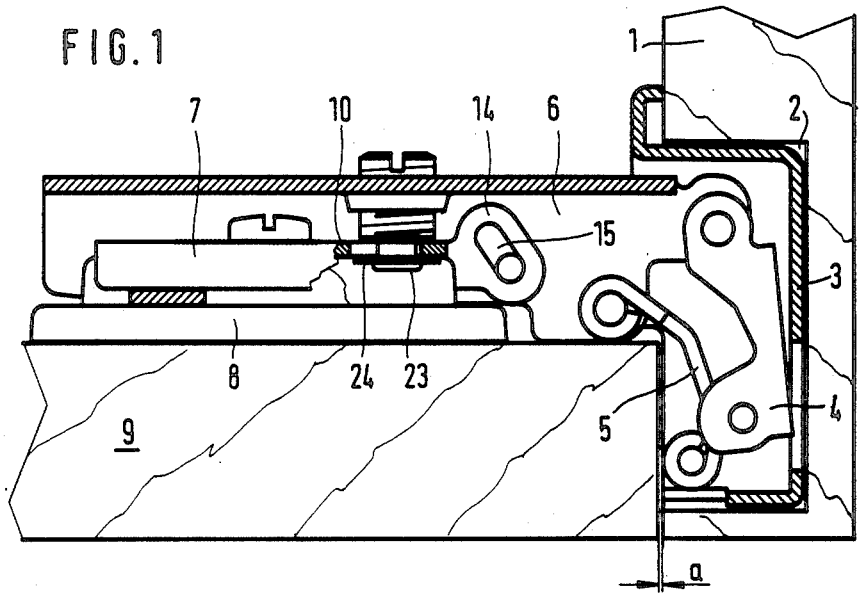
FIG. 1 is a longitudinal sectional view showing a hinge which connects a door to a carrying wall.

Illustrative embodiments of the invention will now be explained in more detail with reference to the drawings.

The pot-shaped hinge member 3 is secured in the usual manner in a milled blind hole 2 formed in the furniture door 1. By means of links 4, 5 and pivot pins arranged in a trapezoidal array the hinge member 3 is connected in known manner to the hinge bracket 6, which is connected by the intermediate plate 7 to the base plate 8, which is fixed to the carrying wall 9 in conventional manner by screws. The intermediate plate 7 is a channel member comprising a web 10 and flanges 11, which are angled from the web 10 and embrace a rectangular web 12 of the base plate 8. The web 12 constitutes a substantially rectangular guide for the flanges 11 of the intermediate plate 7. The web 10 of the intermediate plate 7 is formed with a longitudinal slot, which is not shown and which receives the fixing screw 13, which is adapted to be screwed into the web 12 in order to clamp the intermediate plate 7 against the base plate 8. Adjacent to the fixing screw 13, the web of the hinge bracket is formed with a window aperture, which is not shown and which permits an access to the fixing screw 13 by means of a screwdriver.

Adjacent to the forward end of the web 10 of the intermediate plate 7, the angled flanges 11 of the intermediate plate 7 are provided with tabs 14, which protrude from the web 10 and are formed with inclined slots 15, which receive pins 16, which are riveted to the flanges of the hinge bracket 6.

The flanges 17 of the channel-shaped hinge bracket 6 are formed with angled lugs 18, which extend into guides 19 defined by the lower end faces of the flanges 11 of the intermediate plate 7 and by the base plate 8.

The web 10 of the intermediate plate 7 is provided with an additional slot 20, which receives a tapered shank portion 21 of the adjusting screw 22. The screwthreaded portion of the adjusting screw has been screwed into a flanged tapped hole of the web of the hinge bracket 6. The tapered shaft portion 21 is provided with a rivet head 23, by which a spring washer 24 is held against the underside of the web 10 at the slot 20 so that the adjusting screw 22 is slidable along and rotatable in the slot 20 but is axially fixed.

The hinge bracket 6 can be pivotally moved by a rotation of the adjusting screw. That pivotal movement tends to change the width "a" of the gap between the door 1 and the carrying wall 9. That tendency to change the width "a" is compensated for by a translational movement of the hinge bracket 6 relative to the base plate. To effect such compensating movement, the slot 15 has such an inclination that during a pivotal movement of the hinge bracket the displacement of the hinge bracket in its longitudinal direction will always approximately compensate the tendency of the pivotal movement to change the width of the gap.

Figure 2:
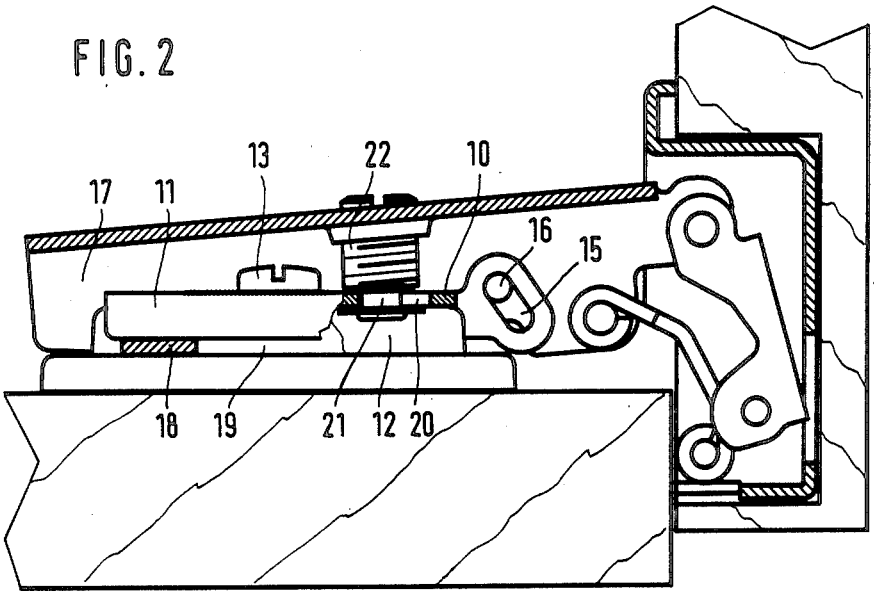
FIG. 2 shows the hinge of FIG. 1 with the hinge bracket fixed in an angular position selected for a lateral adjustment of the door.
Figure 3:
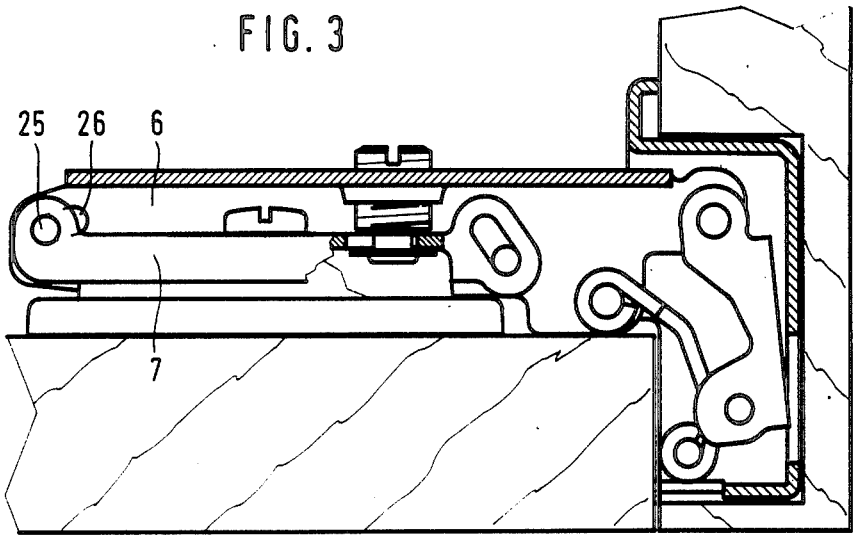
FIG. 3 is a view that is similar to FIG. 1 and shows a second embodiment of the hinge.
Figure 4:
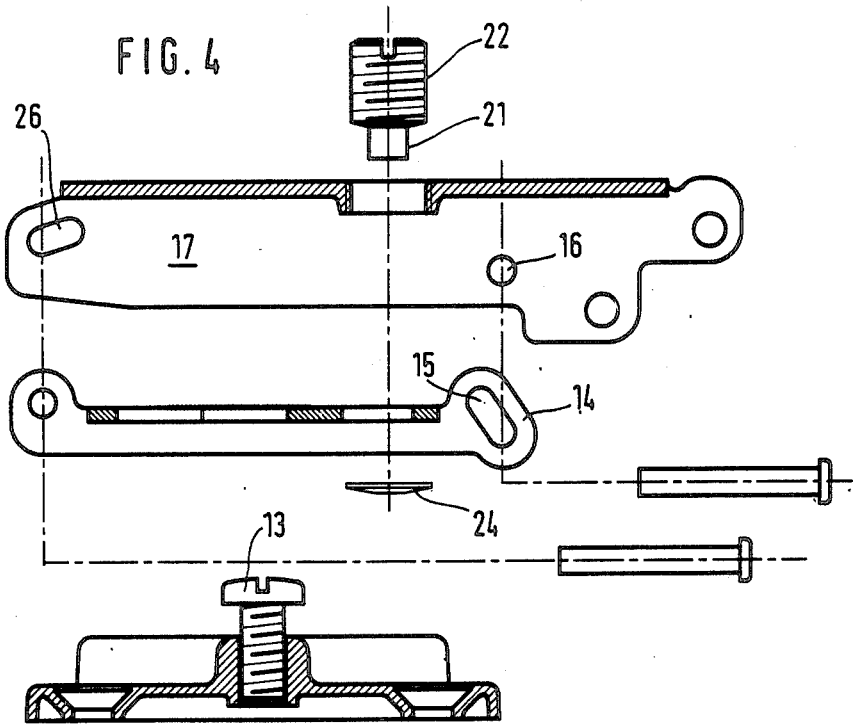
FIG. 4 is an exploded view showing the hinge of FIG. 3.

The embodiment shown in FIGS. 3 and 4 differs from the embodiment shown in FIGS. 1 and 2 only in that the hinge bracket 6 is connected to the intermediate plate by the pivot pin 25, which is guided in the slots 26 formed in respective flanges 17 of the hinge bracket. Each slot 26 has an inclination in a sense which is opposite to that of the slot 15. The slots 15 and 26 define a pivotal axis for the hinge bracket 6. That pivotal axis is defined by the points of intersection of lines which extend through the axes of the pivot and guide pins at right angles to the respective slots 15 and 26.

In the embodiment shown in FIGS. 3 and 4, a given rotation of the adjusting screw 22 will impart to the hinge bracket 6 a larger pivotal movement than in the embodiment shown in FIGS. 1 and 2, in which the rear portion of the hinge bracket 6 is guided in the straight guide 19 by the angled lugs 18.

Figure 5:
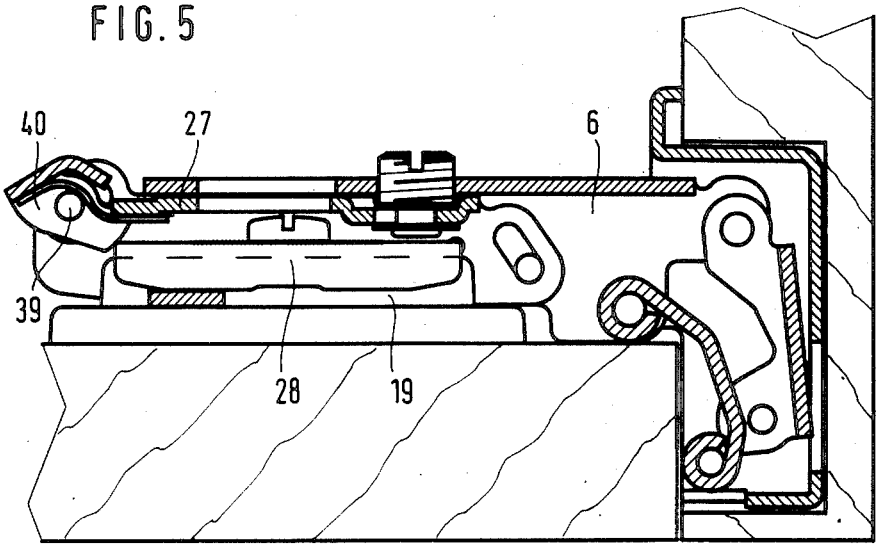
FIG. 5 is a view that is similar to FIG. 3 and shows a third embodiment of a furniture hinge.
Figure 6:
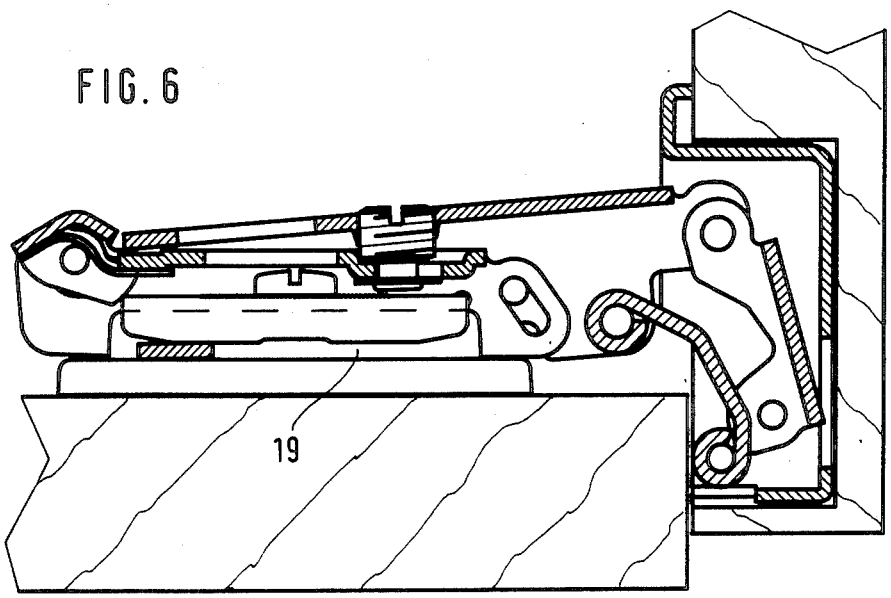
FIG. 6 shows the furniture hinge of FIG. 5 after the hinge bracket has been pivotally moved for a lateral adjustment of the door.
Figure 7:
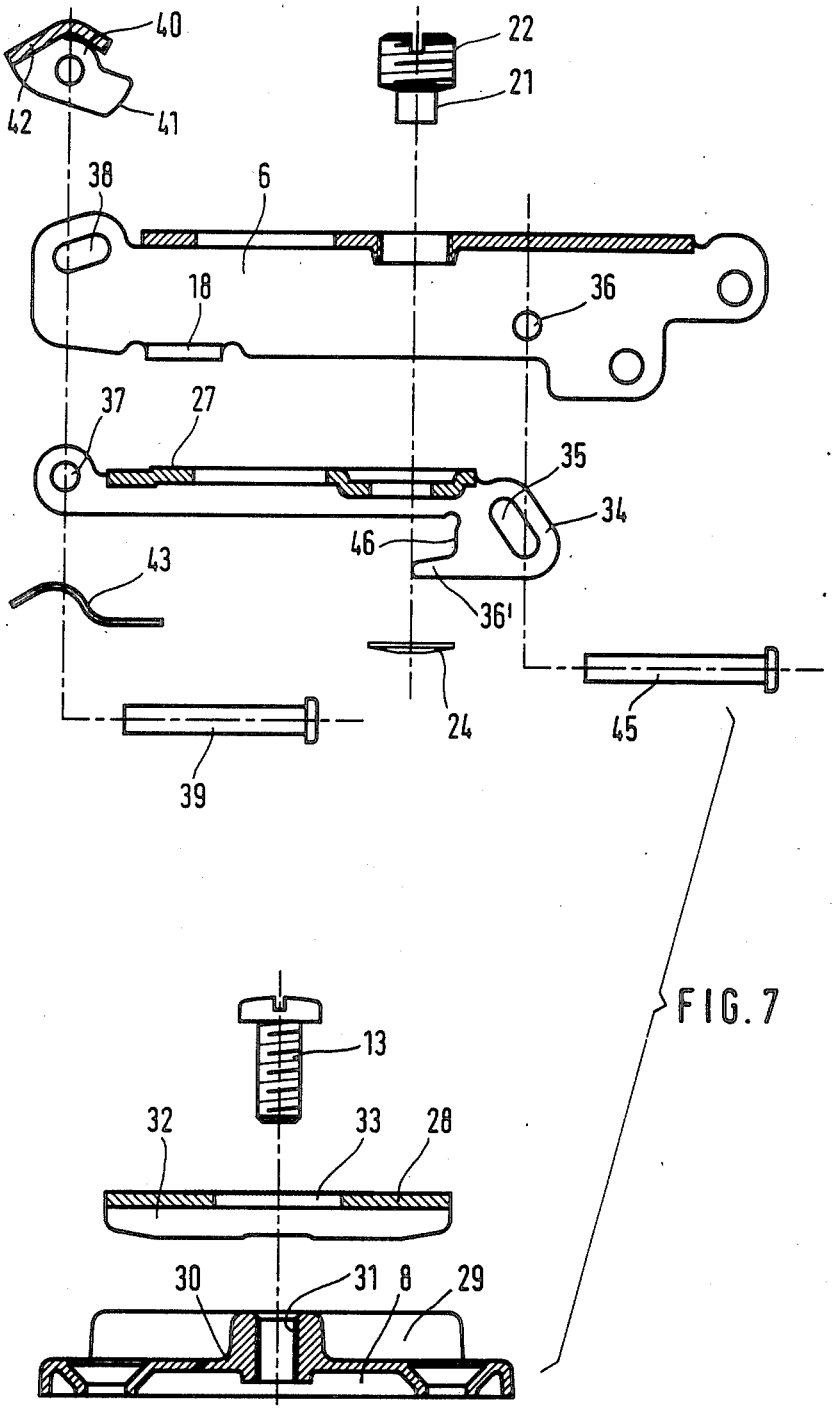
FIG. 7 is an exploded view showing the hinge of FIGS. 5 and 6.
Figure 8:
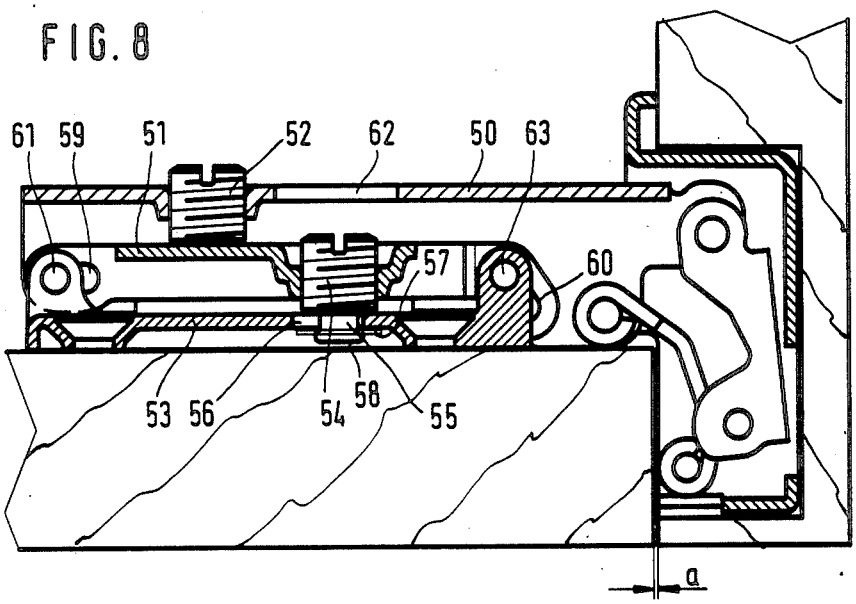
FIG. 8 is a longitudinal sectional view showing a laterally adjustable furniture hinge of a fourth embodiment of a laterally adjustable furniture hinge in an initial position.
Figure 9:
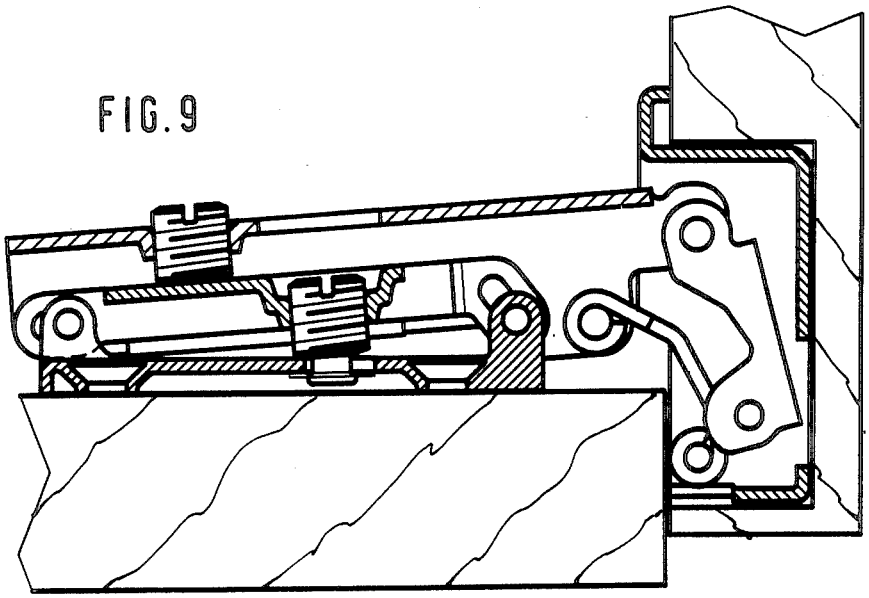
FIG. 9 is a view which is similar to FIG. 8 and shows the furniture hinge after the largest possible lateral adjustment.
Figure 10:
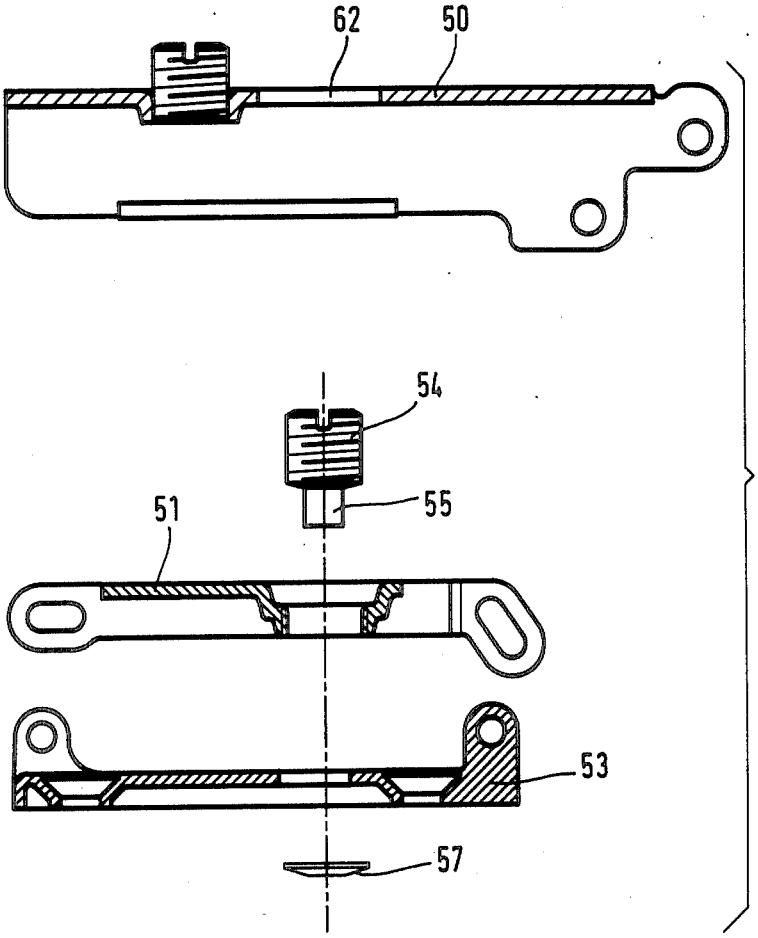
FIG. 10 is an exploded view showing the hinge bracket, the intermediate plate and the base plate of the furniture hinge of FIGS. 8 and 9 in longitudinal section.
Figure 11:
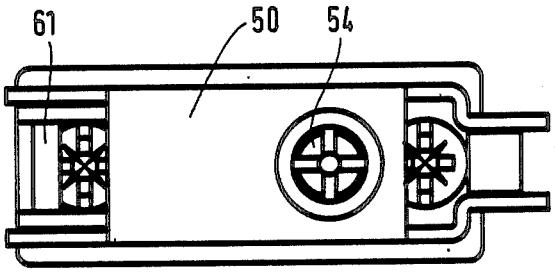
FIG. 11 is a top plan view showing the hinge member of FIG. 10.
Figure 12:
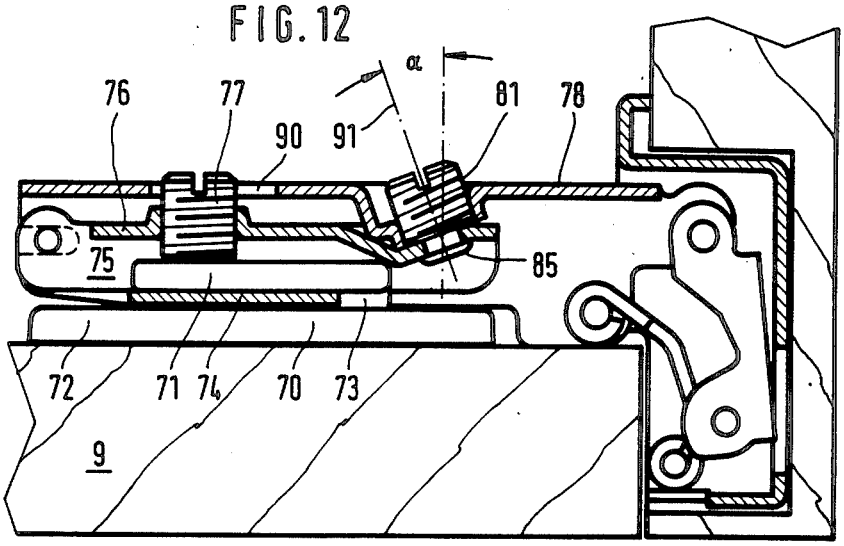
FIG. 12 is a longitudinal sectional view showing a fifth embodiment of a laterally adjustable furniture hinge in an initial position.
Figure 13:
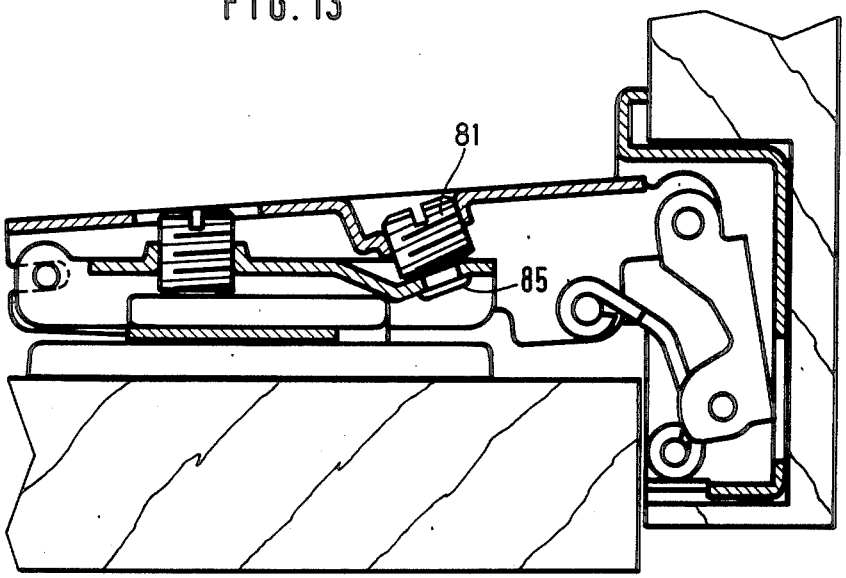
FIG. 13 is a view that is similar to FIG. 12 and shows the furniture hinge after the largest possible lateral adjustment.
Figure 14:
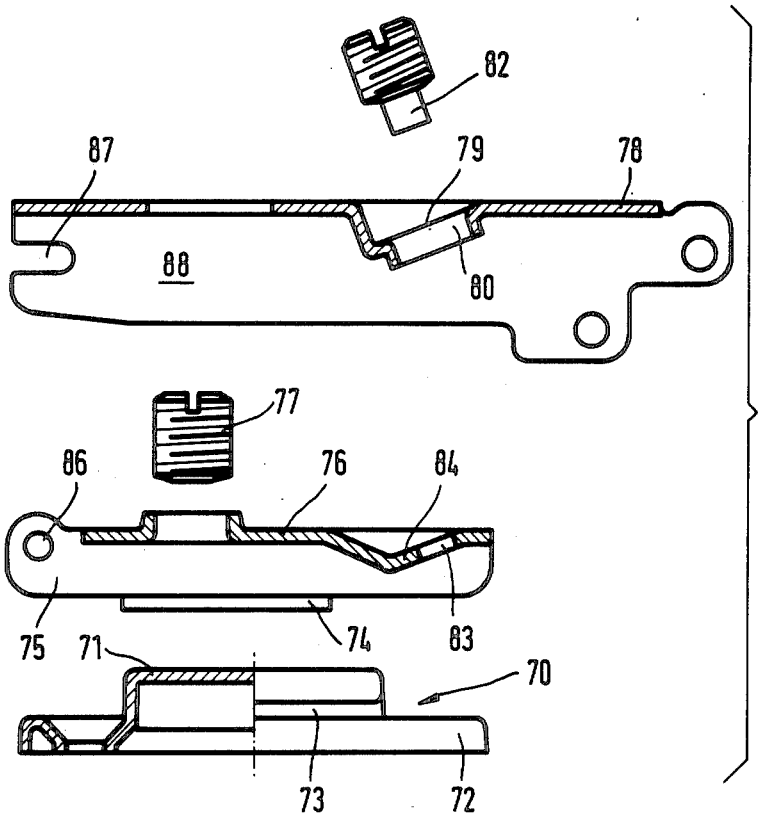
FIG. 14 is an exploded view showing the hinge bracket, the base plate and the intermediate plate of the furniture hinge of FIGS. 12 and 13 in longitudinal section.
Figure 15:
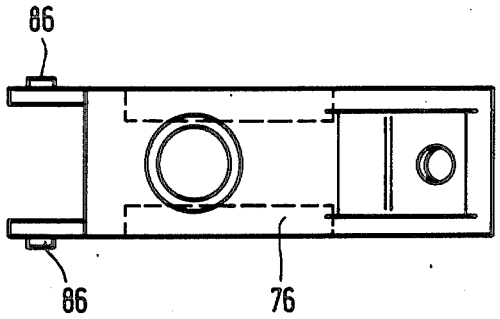
FIG. 15 is a top plan view showing the intermediate plate of FIG. 14.

The embodiment shown in FIGS. 5 to 7 has substantially the same kinematics as the embodiment shown in FIG. 3 and 4 but the intermediate plate 7 has been replaced by the adjusting plate 27, which is adapted to be slidably fitted and releasably locked to a lower intermediate plate 28, which is fixed by screws to the base plate.

The design of the hinge is most clearly apparent from FIG. 7. The base plate 8 is identical to the base plate 8 shown in FIGS. 1 to 4. The lower intermediate plate 28 is fixed to the base plate 8 by the fixing screws 13. The base plate 8 is provided with a web, which is H-shaped in a top plan view and which comprises mutually parallel lateral web bars 29 connected by an intermediate transverse web portion 30, which has a larger width than the web bars 29 and is formed with a tapped bore 31 for engagement by the screw 13. The lower intermediate plate 28 comprises flanges 32, which protrude beyond the web bars 29 of the base plate 8 so that the intermediate plate 28 is longitudinally slidably guided on the web of the base plate. The fixing screw 13 extends through a slot 33 of the intermediate plate 28 so that the gap can be adjusted to an extent determined by the length of that slot 33.

The adjusting plate 27 is also channel-shaped and its flanges are provided in their forward endportions with tabs 34, which are formed with respective inclined slots 35 for guiding the pins 36 secured to the flanges 17 of the hinge bracket. The tabs 34 are also formed with hook-shaped extensions 36', which embrace and engage the lower intermediate plate 28 when the hinge bracket has been slidably fitted. The flanges of the adjusting plate 27 are formed in their rear end portions with bores 37 and the flanges 17 of the hinge bracket are formed in their rear end portions with slots 38.The hinge bracket is pivoted to the adjusting plate by two pivot pins 39, each of which extends through one of the bores 37 and one of the slots 38. The pivoted lever 40 is mounted on the pivot pins 39 between the flanges of the adjusting plate 27 and has one arm that is formed at its end edge with a cam-shaped detent face 41 an another arm that is provided with an fingerpiece 42 for unlocking the lever 40.

In the manner shown in FIGS. 5 and 6 the pivoted lever 40 is biased by the leaf spring 43, which bears on the pivot pin 39, the unlocking fingerpiece 42 and the web of the adjusting plate in such a manner that the spring 43 tends to impact to the pivoted lever a movement in the clockwise sense. The curved faces 41 are eccentric with respect to the pivot pin and define an acute wedge angle so that the detent faces 41 bear in self-biasing engagement on the upper end edge of the web of the adjusting plate and urge the adjusting plate 27 against the intermediate plate 28 without a backlash.

The flanges 17 of the hinge bracket 6 are provided with angled lugs 18, which are longitudinally guided in guiding grooves 19 defined by the base plate 8 and by the edge faces of the flanges of the lower intermediate plate 28.

To mount the hinge bracket 6, its flanges are inserted into the guiding grooves 19 and the hinge bracket is pushed forward in the guiding grooves until that arm of the pivoted lever 40 which is provided with the detent faces 41 has snapped behind the rear edge of the intermediate plate 28 so that the adjusting plate 27 is clamped against the intermediate plate 28 in a self-biasing manner by the hook-shaped portion 36, which constitutes a forward stop portion of the adjusting plate 27.

The two pins 39 connected to respective flanges of the hinge bracket may be replaced by a single, continuous pivot pin 45, as is shown in FIG. 7.

The hook-shaped portions 36' of the flanges of the adjusting plate 27 define U-shaped recesses. The actual stop face 46 is formed on the lower intermediate plate 28 by the bottom of the U-shaped recess.

During a lateral adjustment effected by a pivotal movement of the hinge bracket 6, the spring-loaded detent lever 40 is not displaced in its longitudinal direction relative to the intermediate plate 28 as a result of the tendency to change the width of the gap and is not pivotally moved but will remain in its original locking position without a change in position and without an additional loading. In that locking position the detent lever bears on the detent face 41 of the intermediate plate 28 in self-biasing engagement therewith. As a result, the lateral adjustment will not affect the snap joint so that the hinge bracket can be connected and released in a simple manner and without an adverse effect on the function of the hinge, regardless of whether the hinge is in an adjusted or nonadjusted position.

A further embodiment will not be described with reference to FIGS. 8 to 11 and basically differs from the embodiment shown in FIGS. 3 and 4 only in that the mechanism for effecting a lateral adjustment and a compensation of the tendency to change the width of the gap is provided between the intermediate plate and the base plate rather than between the hinge bracket and the intermediate plate.

The hinge bracket 50 is longitudinally slidably guided on the intermediate plate 51 and is adapted to be clamped in position on the intermediate plate 51 by the clamp screw 52 when the width a of the gap has been adjusted. The intermediate plate 51 is pivotally movable relative to the base plate 53 to an extent which is adjustable by the adjusting screw 54. The latter is screwed into a tapped hole of the intermediate plate 51. The adjusting screw 54 comprises an unthreaded tapered forward shank portion 55, which extends through the longitudinal slot 56 of the base plate 53. The shank portion 55 is provided with a rivet head 58, and a spring washer 57 is provided between the rivet head 58 and the base plate 56 so that the adjusting screw 54 is rotatably mounted in the slot 56 and slidable along the same.

These features of the adjusting mechanism are basically the same as in the mechanism known from German Patent Specification No. 28 15 816.

To ensure that the tendency of a lateral adjustment to the width a of the gap will be compensated in the manner described hereinbefore, the flanges of the channel-shaped intermediate plate 51 are formed with slots 59, 60. The forward slots 60 are inclined toward the gap having the width a. The rear slots 59 may extend in the axial direction of the intermediate plate 51 or may be inclined in a sense that is opposite to the inclination of the slots 60.

The slots 59, 60 receive pivot and guide pins 61, 63, which are mounted on and protrude laterally from the base plate 53.

It will be understood that the slots may alternatively be provided in the flanges of the base plate 53. In that case the pivot and guide pins will be provided on the flanges of the intermediate plate 51.

The web of the hinge bracket 50 is provided with a window aperture 62, through which the adjusting screw 54 is accessible by means of a screwdriver.

A final embodiment will now be described by way of example with reference to FIGS. 12 to 15. The base plate 70 is secured to the carrying wall 9 in the usual manner by means of fixing screws and comprises a raised pedestal like intermediate portion 71. The base portion 72 of the base plate 70 is enlarged in width by the provision of flanges. Adjacent to the flanges, the raised pedestallike portion 71 is formed with laterally disposed guiding grooves 73, which are parallel to the edges of the base portion 72 and receive luglike web portions 74, which are angled from the ends of the flanges 75 of the channel-shaped intermediate plate 76. The web of the intermediate plate 76 is provided with a flanged tapped hole, into which a clamp screw 77 has been screwed. When the intermediate plate 76 has been slidably fitted on the base plate 70, the clamp screw 77 can be tightened to clamp the intermediate plate 76 against the base plate 70.

The hinge bracket 78 is also channel-shaped and is pivotally and longitudinally slidably mounted on the intermediate plate 76. The web of the hinge bracket 78 comprises an embossed depression having a bottom surface 79, which includes an angle of about 20 to 30 degrees with the undeformed web portion of the hinge bracket 78. The bottom surface 79 is formed with a flanged tapped hole 80, into which the adjusting screw 81 has been screwed. The adjusting screw 81 has a tapered forward shank portion 82, which extends through a bore 83 formed in an inclined surface 84 that has been formed by embossing in the web of the intermediate plate 76. On that side of the inclined surface 84 which is opposite to the adjusting screw 81, the shank portion 82 is provided with a rivet head 85 so that the adjusting screw 81 is rotatably mounted and axially fixed in the bore 83. The surface 84 is inclined in the same sense as the bottom surface 79 of the embossed depression of the hinge bracket 78.

The flanges 75 of the intermediate plate 76 are provided with outwardly directed, embossed knoblike projections 86. The flanges 88 of the hinge bracket 78 are provided in their rear end portion with open-ended slots 87, which receive the knoblike projections 86 of the intermediate plate 76 so that the slots 87 constitute guides for the knoblike projections 86 and the hinge bracket 78 is longitudinally slidably guided on the knoblike projections 86.

By a rotation of the adjusting screw 81, the hinge bracket 78 can be pivotally moved relative to the intermediate plate 76 and will be displaced in its longitudinal direction at the same time owing to the inclination of the adjusting screw 81 by a translational movement, which is superposed on the pivotal movement. The axis of the adjusting screw 81 is inclined by an angle $\alpha$ of 20 to 30 degrees from the normal on the longitudinal axis of the hinge bracket 78. The angle $\alpha$ should be so selected that a pivotal movement imparted to the hinge bracket for a lateral adjustment of the door will be accompanied by a longitudinal displacement of the hinge bracket relative to the intermediate plate in such a direction and to such an extent that the tendency of the pivotal movement to the width of the gap will be compensated for.

Adjacent to the clamp screw 77, the web of the hinge bracket 78 is formed with a windowlike aperture 90, through which the clamp screw 77 is freely accessible.

I claim:

1. A furniture hinge comprising a pot-shaped hinge member which is adapted to be secured to a door or flap and is connected to a hinge bracket by means of two links and pivot pins forming a rectangular or trapezoidal array, a base plate which is adapted to be secured to a carrying wall so that said wall defines a gap with said door or flap, an intermediate plate provided with flanges which is mounted on said base plate and adjustable relative thereto at least in the longitudinal direction of said intermediate plate and which pivotally connects said hinge bracket to said base plate, and an adjusting screw, which is screwed into said hinge bracket and is rotatably mounted in and axially fixed to said intermediate plate and is operable to effect a lateral adjustment of said door or flap by imparting a pivotal movement to said hinge bracket and to retain said hinge bracket in different angular positions, characterized in that the hinge bracket is guided in guide means such as the flanges on said intermediate plate which cooperate with said hinge bracket through means such as angled lugs on said hinge bracket, a pin at least on said hinge bracket and the adjusting screw on said hinge bracket which is rotatably mounted in and axially fixed to said intermediate plate in such a manner so that during a pivotal movement said hinge bracket will be displaced in its longitudinal direction relative to the intermediate plate to such an extent as to compensate for the tendency of said pivotal movement of said hinge bracket to change the width of said gap.

2. A furniture hinge according to claim 1, characterized in that the intermediate plate and the hinge bracket are channel-shaped members and both are provided with flanges, at least one flange of said plate and said hinge bracket is formed with a slot which is inclined towards the gap and receives a pin which is secured to the adjacent flange of the other channel-shaped member, the adjusting screw has a tapered forward shank portion which extends through a longitudinally extending slot formed in the intermediate plate and through a bore in a spring washer, and said shank portion is provided with a rivet head by which the adjusting screw is rotatably mounted and axially fixed in the slot.

3. A furniture hinge according to claim 2, characterized in that at least one flange of each of the channel-shaped intermediate plate and the hinge bracket members is provided in its bearing portion with a second slot which is inclined in a sense that is opposite to the sense of inclination of the first slot and which receives a pin that is secured to a flange of the other channel-shaped member.

4. A furniture hinge according to claim 1, characterized in that the intermediate plate and the hinge bracket are channel-shaped and said intermediate plate is longitudinally slidably guided on a web provided on the base plate and is adapted to be fixed in position by a fixing screw, the hinge bracket and the intermediate plate are provided with flanges and each flange of the channel-shaped hinge bracket is provided with an angled lug which extends into one of two guiding grooves defined by the end faces of the flanges of said intermediate plate and by said base plate.

5. A furniture hinge according to claim 1, characterized in that the guides and the means which cooperate with said guides and serve to longitudinally displace the hinge bracket so as to compensate for the tendency of the pivotal movement to change the width of the gap are independent of the means by which the hinge bracket is secured to the base plate and said base plate is symmetrical with respect to its longitudinal and transverse axes.

6. A furniture hinge according to claim 1, characterized in that the intermediate plate constitutes an additional adjusting plate, which is adapted to be releasably locked to a lower intermediate plate, which is longitudinally slidably guided on the base plate and adapted to be fixed in position to the base plate by a clamp screw.

7. A furniture hinge according to claim 6, characterized in that the additional adjusting plate is provided with a stop for limiting the movement by which said additional adjusting plate is slidably fitted on the lower intermediate plate, and said addtional adjusting plate is provided at its rear end with a spring-loaded detent lever having a face in the shape of an eccentric cam, and said detent lever snaps into a detent position when said additional adjusting plate has been slidably fitted on the lower intermediate plate, the detent face bearing in said detent position on the rear end face of said lower intermediate plate in a self-biasing engagement.

8. A furniture hinge according to claim 7, characterized in that the stop consists of a hook-shaped forward portion on the additional adjusting plate and embraces the forward side of the lower intermediate plate.

9. A furniture hinge according to claim 6, characterized in that the lower intermediate plate is provided with flanges, the hinge bracket is provided with flanges and angled lugs, which are angled from its flanges and guided in guides defined by the lower end faces of the flanges of said lower intermediate plate and the base plate.

10. A hinge bracket according to claim 6, characterized in that the lower intermediate plate is channel-shaped and is symmetrical with respect to its longitudinal and transverse axes.

11. A furniture hinge comprising a pot-shaped hinge member which is adapted to be secured to a door or flap and is connected to a hinge bracket by means of two links and pivot pins forming a rectangular or trapezoidal array, a base plate provided with a longitudinal slot and which is adapted to be secured to a carrying wall so that said wall defines a gap with said door or flap, an intermediate plate which is pivoted to said base plate, and an adjusting screw, which is screwed into said base plate and adapted to locate said intermediate plate in different angular positions, said hinge bracket being longitudinally adjustably mounted on and adapted to be fixed to said intermediate plate, characterized in that the intermediate plate is guided on the base plate in such a manner so that a pivotal movement of said intermediate plate will be accompanied by a displacement thereof in its longitudinal direction relative to the base plate to such an extent that the tendency of said pivotal movement relative to the width of said gap will be compensanted for, said adjusting screw being provided with a tapered threadless forward shank portion which extends through the longitudinal slot of said base plate and through the bore of a spring washer, and said tapered threadless forward shank portion being provided with a rivet head for rotatably and longitudinally slidably mounting said adjusting screw in the slot in said base plate.

12. A furniture hinge according to claim 11, characterized in that the intermediate plate is channel-shaped and provided with flange, at least one flange of said intermediate plate is provided with a first slot that is inclined toward the gap and in its rear portion with a second slot which extends substantially in the longitudinal direction of said intermediate plate, said slots receiving respective pins secured to an adjacent flange provided on the base plate.

13. A furniture hinge according to claim 11, characterized in that the hinge bracket is adapted to be secured by a snap joint to a further intermediate plate, which is mounted on the pivoted intermediate plate and adapted to be adjusted thereon and to be fixed in position.

14. A furniture hinge comprising a pot-shaped hinge member, which is adapted to be secured to a door or flap and is connected to a hinge bracket by means of two links and pivot pins forming a rectangular or trapezoidal array, a base plate, which is adapted to be secured to a carrying wall, said hinge bracket being mounted to be longitudinally slidable and pivotally movable relative to said base plate, and an adjusting screw, which is screwed into the hinge bracket and is rotatably mounted and axially fixed to the base plate or to an intermediate plate, which is connected to said base plate, which adjusting screw is adapted to impart a pivotal movement to said hinge bracket to different angular positions for effecting a lateral adjustment of the door or flap, characterized in that the axis of the adjusting screw has such an inclination that a pivotal movement of the hinge bracket will be accompanied by a longitudinal displacement of the hinge bracket on the base plate or intermediate plate in such a direction and to such an extent as to compensate the tendency of said pivotal movement to change the width of the gap between said carrying wall and said door or flap.

15. A furniture hinge according to claim 14, characterized in that the hinge bracket is channel-shaped and provided with flanges, each flange of the hinge bracket being formed in its rear end portion with a slot, which receives a lateral pin or knoblike protrusion on the base plate or intermediate plate, and serving to guide the hinge bracket.

16. A furniture hinge according to claim 15, characterized in that the slots are open at their rear ends.

17. A furniture hinge according to claim 14, characterized in that the hinge bracket is channel-shaped and is provided with a web having an inclined surface formed by embossing and with a tapped hole which engages the adjusting screw.

18. A furniture hinge according to claim 14, characterized in that the base plate or intermediate plate is provided with an inclined surface formed by embossing and provided with a bore to receive a tapered forward shank portion of the adjusting screw, and said tapered forward shank portion is provided with a rivet head for rotatably mounting and axially fixing said shank portion in said bore.

19. A furniture hinge according to claim 15, characterized in that the laterally disposed knoblike projections in the flanges of the channel-shaped base plate or intermediate plate are formed by embossing.

20. A furniture hinge according to claim 1, characterized in that at least an adjustable plate bearing the hinge bracket is provided with guiding means in which the pin on the hinge bracket is guided and the pivotal movement of said hinge bracket along with the displacement thereof in its longitudinal direction is around a remote pivotal axis which compensates for the change in the gap between the carrying wall and the door or flap during said pivotal movement and which pivotal axis is defined by the point of intersection of lines which extend through the axis of said pin and at a right angle to said guiding means.

* * * * *